United States Patent [19]

Wright

[11] 4,150,774

[45] Apr. 24, 1979

[54] LOW LINE TACKER

[75] Inventor: Owen M. Wright, Swansea, Wales

[73] Assignee: Ofrex Group Limited, London, England

[21] Appl. No.: 832,105

[22] Filed: Sep. 9, 1977

[30] Foreign Application Priority Data

Sep. 13, 1976 [GB] United Kingdom ..... 37921/76

[51] Int. Cl.[2] ..... B25C 5/10

[52] U.S. Cl. ..... 227/132; 227/146

[58] Field of Search ..... 227/132, 146

[56] References Cited

U.S. PATENT DOCUMENTS

| | | | |
|---|---|---|---|
| 1,601,324 | 9/1926 | Reynolds | 227/132 |
| 2,493,640 | 1/1950 | Peterson | 227/132 |
| 3,758,016 | 9/1973 | Olney et al. | 227/132 |

*Primary Examiner*—Roy Lake
*Assistant Examiner*—Paul A. Bell
*Attorney, Agent, or Firm*—Mason, Fenwick & Lawrence

[57] ABSTRACT

A trigger-operated staple tacking device comprises a body and an operating handle pivotally connected at one end to the body, operation of the trigger to actute a staple driving mechanism of the device being effected by squeezing the other end of the handle and the body together against the action of a return spring operative to return the handle to a position projecting from the body. The body has a recess to receive the handle when the device is not in use, a movable catch on the handle co-operating with a clip on the body to hold the handle in the recess. The staple driving mechanism comprises a linearly movable staple driving blade and resilient means extending transversely of the path of movement of the blade and biasing the blade towards a staple ejection slot, the blade being movable by the trigger out of the staple ejection slot against the action of the resilient means whereby the blade is driven to eject a staple upon release of the blade by the trigger.

5 Claims, 1 Drawing Figure

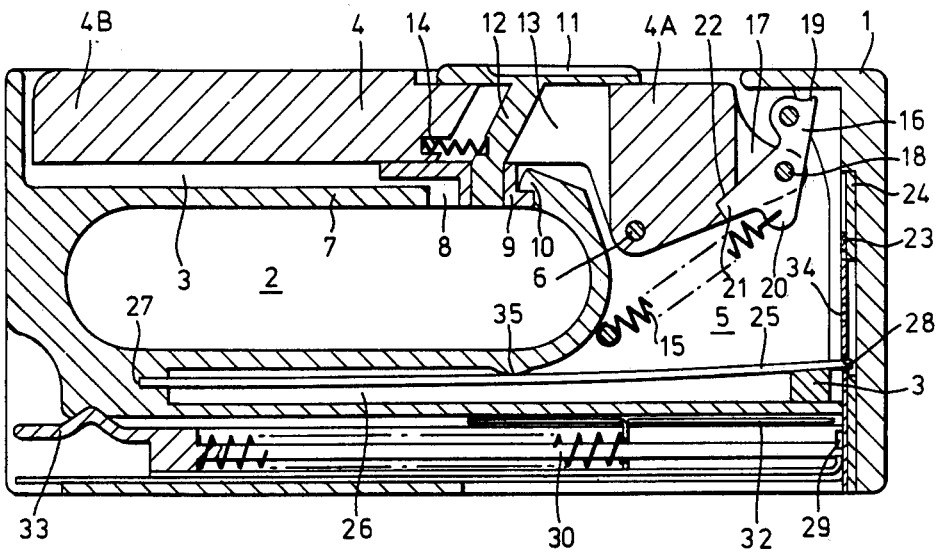
4B
4
14
12
13
11
4A
22
17
19
1
16
18
24
23
34
28
3
7
8
9
10
6
3
2
27
35
21
20
5
25
15
33
26
30
32
29

LOW LINE TACKER

BACKGROUND OF THE INVENTION

This invention relates to a trigger-operated staple tacking device.

A known trigger-operated staple tacking device comprises a body and an operating handle which is pivotally connected at one end to the body, operation of the trigger to actuate a staple driving mechanism of the device being effected by squeezing the other end of the handle and the body together against the action of a return spring operative to return the handle to a position projecting from the body on release of the handle.

The staple driving mechanism of the known device comprises a cup-shaped striker block which is linearly moveable perpendicularly to an elongate staple-carrying element and which is biased into engagement with an anvil adjacent to the staple-carrying element by a helical compression spring extending in the direction of movement of the striker block. A staple driving blade is secured to the striker block so as to project beyond the anvil into a staple ejection slot adjacent to a supply end of the staple-carrying element. The operating handle is operatively connected to a rocker lever carrying a toe piece which engages in a recess of the striker block. When the handle is squeezed, the rocker lever pivots, causing the toe piece to move the striker block away from the anvil against the force of the helical compression spring. The staple driving blade is thereby retracted from the staple ejection slot, allowing a staple feeder in the staple-carrying element to introduce a staple into the ejection slot. Continued squeezing of the operating handle causes the toe piece to slip out of the recess in the striker block which is then driven forcibly back towards the anvil by the compression spring to cause the driving blade to eject the staple from the ejection slot.

In the known staple tacking device, the pivotally mounted handle of the device projects permanently from the body when the device is not in use.

Whilst this known device operates perfectly satisfactorily, the fact that the operating handle projects permanently from the body and the construction of the staple driving mechanism using a helical spring extending in the direction of movement of the striker block mean that the device is inconveniently shaped and rather bulky for some applications.

SUMMARY OF THE INVENTION

It is an object of the present invention to provide an improved trigger-operated staple tacking device.

According to the invention, in one aspect thereof, there is provided a trigger-operated staple tacking device comprising a body and an operating handle which is pivotally connected at one end to the body, operation of the trigger to actuate a staple driving mechanism of the device being effected by squeezing the other end of the handle and the body together against the action of a return spring operative to return the handle to a position projecting from the body on release of the handle, in which device the body has a recess to receive the handle in a storage position when the device is not in use, co-operating retaining means being provided on the handle and the body to hold the operating handle in its storage position in the body recess against the action of the return spring.

Preferably, the body recess receiving the operating handle is dimensioned that the operating handle lies wholly within the outline of the body when such handle is in its storage position.

Conveniently, the co-operating retaining means comprises a movable catch provided on the handle and a clip provided on the body.

According to another aspect of the invention, there is provided a trigger-operated staple tacking device comprising a body and an operating handle which is pivotally connected at one end to the body, operation of the trigger to actuate a staple driving mechanism of the device being effected by squeezing the other end of the handle and the body together against the action of a return spring operative to return the handle to a position projecting from the body, in which device the staple driving mechanism comprises a linearly movable staple driving blade, and resilient means extending transversely of the path of movement of the staple driving blade and operative to bias the blade towards a staple ejection slot adjacent to a supply end of a staple-carrying element, such staple driving blade being movable by the trigger out of the staple ejection slot against the biasing force of the resilient means whereby the resilient means drives the blade into the staple ejection slot to eject a staple upon release of the blade by the trigger.

Preferably, the resilient means comprises a leaf spring having one end anchored to the body and its other end operatively engaged with the staple driving blade.

BRIEF DESCRIPTION OF THE DRAWINGS

In order that the invention may be readily understood, an embodiment thereof will now be described, by way of example, with reference to the accompanying drawings, in which the single FIGURE is a vertical section through a staple tacking device embodying the invention.

DESCRIPTION OF PREFERRED EMBODIMENT

Referring to the drawing, a staple tacking device embodying the invention comprises an upstanding hollow body 1 of rectangular shape having a horizontal elongate aperture 2 through which the fingers of one hand are passed when holding the device. The aperture 2 may be provided with a liner (not shown) made of rubber or the like to facilitate the holding and gripping of the device.

The top of the body 1 is formed with a channel-shaped recess 3 defined by upstanding parallel longitudinal walls of the body 1, such recess being adapted to accommodate an operating handle 4 of the device in a storage position as shown in the drawing within the outline of the body when the device is not in use. The handle 4 has an enlarged end 4A which is pivotally connected to the body 1 in a chamber 5 of the body by a pivot 6 fixed to the body. A floor 7 of the recess 3 is formed with an aperture 8 and the handle 4 is held in the recess 3 in the storage position by a movable catch 9 provided on the underside of the handle and projecting into the aperture 8 to co-operate with a clip 10 formed in the floor 7 at the edge of the aperture 8.

The catch 9 is controlled by a slidable button 11 positioned on the top of the handle and connected to the catch 9 by an operating link 12 passing through an aperture 13 formed in the handle. A biasing spring 14 acts on the link 12 to bias the catch 9 forwardly into engagement with the clip 10. By sliding the button 11 rearwardly to move the link 13 against the action of the spring 15, the catch 9 is released from the clip 10 and the handle 4 is pivoted outwardly from the recess 3 into an operating position by a return spring 15 acting on the end 4A of the handle 4 as will be described hereinafter.

The handle 4 carries at its end 4A a trigger 16 which is pivotally mounted in a recess 17 of the handle 4 by a pivot 18. The trigger has a nose 19. The return spring 15 is connected to a lug 20 on the trigger 16 and biases the trigger in a clockwise direction about its pivot 18 to bring an arm 21 of the trigger into engagement with an abutment surface 22 of the handle 4. The trigger is thus prevented from further rotation in the clockwise direction but is free to rotate anti-clockwise against the action of the spring 15.

A staple driving mechanism of the device comprises a vertically movable staple driving blade 23 guided by a blade bearing 24. A leaf spring 25 is disposed in a longitudinal cavity 26 of the body 1 and has one end 27 fixed to the body and its other end received in a first aperture 28 of the staple driving blade 23. The spring 25 biases the staple driving blade 23 into a staple ejection slot 29 adjacent to an open end of a longitudinally extending staple carrier 30 of the device. A rubber stop 31 is provided on the floor of the longitudinal cavity 26 to limit the downward movement of the leaf spring 25 and the blade 23, and a cam 35 is provided on the roof of the cavity 26. The staple carrier 30 incorporates a staple feed mechanism which biases staples 32 in the staple carrier towards the staple ejection slot 29 so that the foremost staple in the staple carrier is pressed against the rear face of the staple driving blade 23 when the blade projects into the staple ejection slot. The staple carrier 30 is releasably clipped at 33 to the body 1 to allow withdrawal and refilling of the carrier. The blade 23 has a second aperture 34 in which the nose 19 of the trigger 16 engages during movement of the handle 4 into its operating position.

Starting with the device in the storage position shown in the drawing, the catch 9 is released so that the return spring acts via the trigger 16 to move the handle 4 into its operating position, in which position the nose 19 of the trigger is engaged in the second recess 34 of the blade 23. To eject a staple, the free end 4B of the handle 4 and the body 1 are squeezed together so that the nose 19 of the trigger 16 presses upwardly in the second aperture 34 of the staple driving blade 23, thereby raising the staple driving blade and allowing a staple 32 to be introduced by the staple feed mechanism into the staple ejection slot 29 beneath the driving blade 23. During this upward movement, the leaf spring 25 is flexed upwardly about the curved surface of the cam 35 and is then released at the end of the upward movement, when the nose 19 of trigger 16 disengages from the second aperture 34 of the staple driving blade 23, to propel the staple driving blade downwardly and thus eject the staple positioned in the staple ejection slot. The rubber stop 31 limits the downward movement of the leaf spring and therefore of the staple driving blade.

On release of the handle, the return spring 15 again pivots the handle 4 outwardly, the spring 15 allowing the trigger 16 to move downwardly in contact with the staple driving blade until the nose 19 of the trigger enters the second aperture 34 in the staple driving blade, thereby positioning the handle for the next staple driving operation.

In use of the device, the released catch 9 remains in a position such as to prevent the handle from penetrating too far into the recess 3 and trapping the user's hand. After use of the device, the button 11 is operated to allow the handle 4 to be introduced fully into the recess 3 and subsequent release of the catch retains the handle in its storage position in the recess.

I claim:

1. A trigger-operated staple tacking device comprising a body, an operating handle pivotally connected at one end to said body, a trigger-actuated staple driving mechanism, a return spring operatively connecting said body and said handle, operation of the trigger to actuate the staple driving mechanism of the device being effected by squeezing the end of said handle opposite the pivoted end and said body together against the action of the return spring, said return spring being operative to return said handle to a position projecting from said body on release of said handle, said body having a channel-shaped recess to receive the whole of said operating handle in a storage position when the device is not in use, cooperating retaining means operatively connecting said handle and said body in said body recess to hold said operating handle in its storage position in said body recess against the action of said return spring.

2. A device according to claim 1, wherein said cooperating retaining means comprises a movable catch on said handle and a clip on said body.

3. A device according to claim 2, wherein said movable catch on said handle is controlled by a slidable button on said handle, said button being connected to said catch by an operating link passing through an aperture formed in said handle.

4. A device according to claim 1, wherein said staple driving mechanism comprises a linearly moveable staple driving blade, a staple-carrying element mounted on said body and having a supply end, a staple ejection slot on said body adjacent to said supply end of said staple-carrying element, and resilient means extending transversely of the path of movement of said staple driving blade and operative to bias said blade toward said staple ejection slot, said staple driving blade being movable by the trigger out of the staple ejection slot against the biasing force of said resilient means whereby said resilient means drives said blade into the staple ejection slot to eject a staple upon release of said blade by the trigger.

5. A device according to claim 4, wherein said resilient means comprises a leaf spring having one end anchored to said body and its other end operatively engaged with said staple driving blade.

* * * * *